United States Patent [19]

Tax et al.

[11] 3,994,401

[45] Nov. 30, 1976

[54] CRANE EQUIPPED WITH DUAL TROLLEYS

[75] Inventors: Hans Tax, Munich; Klaus Hösler, Eichenau, both of Germany

[73] Assignee: Hans Tax, Munich, Germany

[22] Filed: Dec. 5, 1975

[21] Appl. No.: 638,154

[30] Foreign Application Priority Data

Dec. 6, 1974 Germany ..... 2457864

[52] U.S. Cl. ..... 212/56; 212/63; 212/48; 212/35 R; 254/145; 254/183

[51] Int. Cl.[2] ..... B66C 23/06

[58] Field of Search ..... 212/1, 56, 58 R, 63, 212/19–20, 27, 35 R, 46 R, 47, 48, 18; 254/145, 183

[56] References Cited

UNITED STATES PATENTS

| | | | |
|---|---|---|---|
| 2,361,331 | 10/1944 | Taylor | 212/56 |
| 2,413,701 | 1/1947 | Favie et al. | 212/56 |
| 3,250,400 | 5/1966 | Bennett | 212/46 R |
| 3,402,824 | 9/1968 | Zweifel | 212/56 X |
| 3,883,859 | 5/1975 | Ancheta | 212/39 R |

FOREIGN PATENTS OR APPLICATIONS

| | | | |
|---|---|---|---|
| 1,212,462 | 3/1960 | France | 212/63 |
| 1,467,735 | 12/1966 | France | 212/18 |
| 2,222,591 | 11/1972 | Germany | 212/63 |
| 2,257,717 | 6/1973 | Germany | 212/18 |

*Primary Examiner*—Frank E. Werner
*Assistant Examiner*—R. B. Johnson
*Attorney, Agent, or Firm*—Hans Berman

[57] ABSTRACT

In a crane having two crabs or trolleys on an approximately horizontal beam of the crane, the trolleys are moved along the beam by two cables whose ends are wound on a common, motor-driven drum, and which are trained over pulleys on the beam and on the trolleys in such a manner that both trolleys are moved jointly at one half of the circumferential drum speed or one trolley is moved at the full drum speed when the other trolley is arrested.

6 Claims, 5 Drawing Figures

CRANE EQUIPPED WITH DUAL TROLLEYS

BRIEF SUMMARY OF THE INVENTION

This invention relates to cranes equipped with dual trolleys, and particularly to a crane provided with an improved drive arrangement for moving the trolleys along the beam in a path having at least a major horizontal component.

In a widely used crane of the type described, the trolleys are driven by means of respective sets of chains, cables or ropes, hereinafter jointly referred to as elongated tension members, associated with respective cable drums. When one tension member is unwound from a cable drum, another tension member is wound on the drum. The free ends of the tension members are attached to a trolley for pulling the trolley along the beam in opposite, respective directions. In order to permit joint or individual movement of the trolleys, the known arrangement requires two independent drives for the two cable drums. When only one trolley is operated, not only the other trolley, but also the associated driving apparatus stands idle.

It has been proposed to avoid this uneconomical use of equipment by connecting both cable drums with a single prime mover through a planetary gear transmission. One drum is drivingly connected with the ring gear and the other drum with the planet carrier of the transmission while the sun gear is driven by the prime mover. When both trolleys or crabs are to be moved in unison, the planet carrier and the ring gear are locked to the sun gear for joint rotation. If one of the trolleys is arrested, the other one is driven at a speed different from the input speed of the transmission. While this arrangement is effective, it is relatively expensive to build and to maintain.

In the absence of an available, inexpensive and rugged drive system for the two crabs or trolleys, cranes equipped with dual trolleys have not found the wide acceptance which their advantages deserve.

Many a crane is called upon to lift loads near its full, rated capacity on rare occasions only, and a single trolley is often much heavier than is needed for the load at hand. Much power is wasted on accelerating and decelerating the overdimensioned trolley. When two relatively light trolleys are provided, both may be employed jointly to lift a very heavy load, while one may be sufficient to handle smaller loads at a significant power saving. Since the full driving power available can move one of the two trolleys at higher speed, the crane can handle a greater number of relatively light loads in the same period than can be moved by a single, heavy trolley.

When the beam of the crane is cantilevered from a single supporting column, and a load is to be lifted by a crab located on the free end of the beam remote from the column, the torque exerted by a heavy single crab may significantly reduce the maximum load capable of being hoisted so that a lighter crab may hoist a heavier load.

It is a primary object of this invention to minimize the cost and complexity of the drive arrangement for the two trolleys or crabs of a crane so as to overcome an important obstacle to wider use of dual-trolley cranes.

In the drive arrangement of the invention, there is provided a single cable drum rotatable about its axis and secured against movement longitudinally of the crane beam. A drive motor may alternatively rotate the drum about its axis in two opposite directions. Two elongated tension systems, or systems of tension elements, include each two flexible, terminal portions fastened to the drum and a tension reversing portion movably secured to a respective one of the two longitudinal end portions of the crane beam and longitudinally connecting the terminal portions. The terminal portions of one system are wound on the drum, and the terminal portions of the other system are being unwound when the drum is rotated in one direction, and vice versa. A first set of guide elements guides each of the terminal portions of the one system from the drum to the tension reversing portion of the one system in two strands trained in a loop over respective first pulleys on the two trolleys. The strands extend from the associated first pulleys toward the tension reversing portion of the one system. A corresponding second set of guide elements guides the terminal portions of the other system from the drum to the tension reversing portion of the other system in two strands trained in a loop over respective second pulleys on the trolleys. These strands extend from the associated second pulleys toward the tension reversing portion of the other system.

Other features, additional objects, and many of the attendant advantages of this invention will readily be appreciated as the same becomes better understood from the following detailed description of preferred embodiments when considered in connection with the appended drawing in which.

Figure 1:
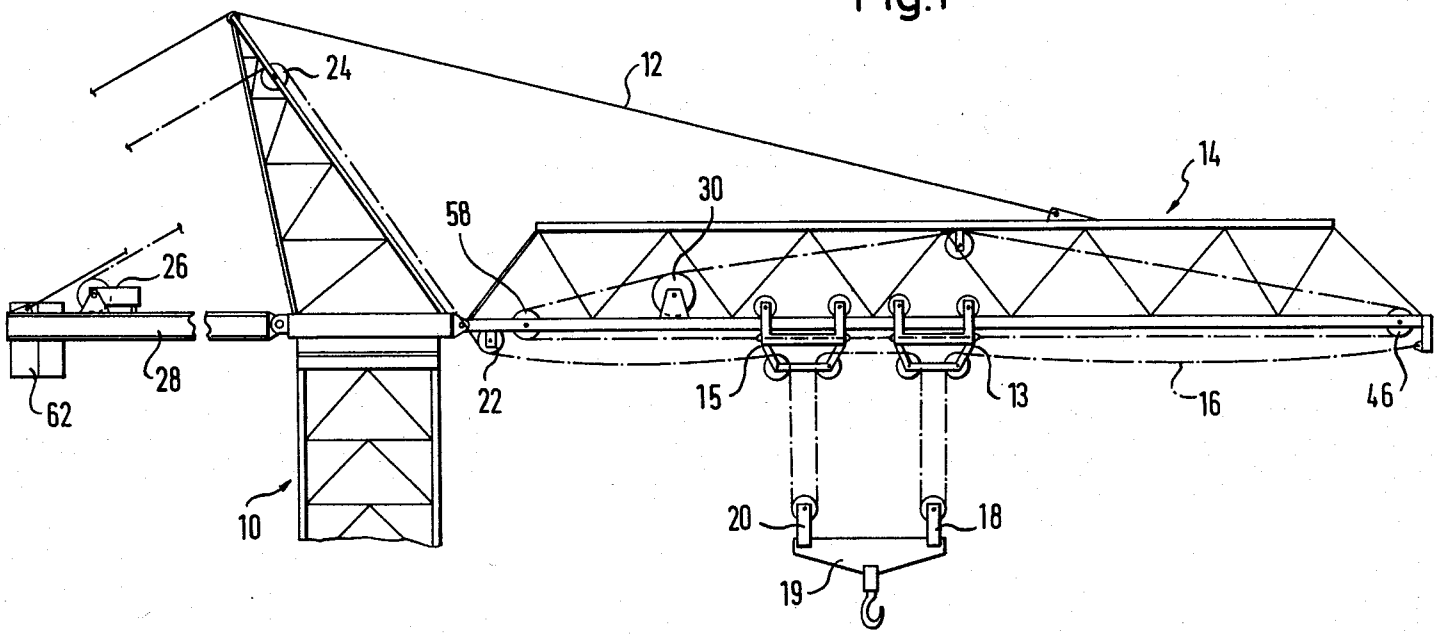
FIG. 1 shows a crane according to the invention in fragmentary side elevation.

Referring now to the drawing in detail, and initially to FIG. 1, there is shown only as much of a basically conventional cantilever crane as is necessary for an understanding of the invention. An upright column 10 of lattice girder construction supports a horizontally elongated beam 14 of similar type. One end portion of the beam 14 is pivotally fastened to the column 10, and the other end portion is attached to a cable 12 leading to the top of the column 10 and permitting the beam to be raised and lowered.

The beam 14 provides a track on which two trolleys or crabs 13, 15 may travel in the predominantly horizontal direction of beam elongation. One end of a hoisting cable 16 is attached to the free end portion of the beam 14, and the hoisting cable is trained over pulleys on the two trolleys 13, 15 to form two depending loops in which respective loading hooks 18, 20 are suspended from the trolleys. A common load carrier 19 is suspended from the hooks 18, 20 in the illustrated condition of the crane. The hoisting cable 16 is trained from the trolley 15 over guide pulleys 22, 24 at the fastened end portion of the beam 14 and near the top of the column 10 respectively and is wound on the cable drum of a winch 26. The winch is mounted on a platform 28 pivotally secured to the column 10 opposite the beam 14 and provided with a counterweight 62.

The structure described so far is conventional and its mode of operation is well understood.

This invention is concerned more specifically with the drive mechanism for moving the trolleys 13, 15 along the beam 14 which is only partly represented in FIG. 1 by a cable drum 30 rotatably mounted in fixed brackets on the beam 14 near the pivotally fastened end portion of the beam and by pulleys 46, 58 on the two longitudinal end portions of the beam 14 respectively.

Figure 2:
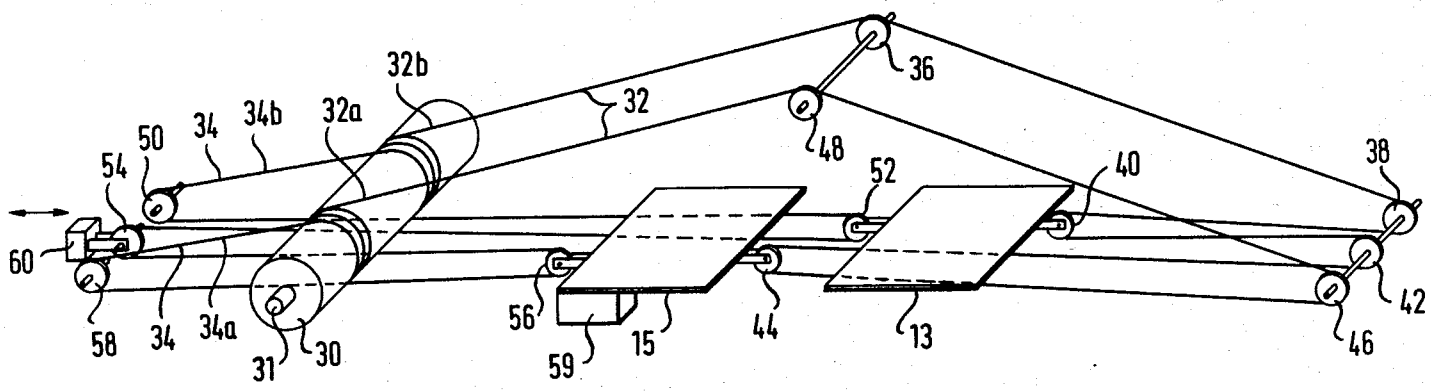
FIG. 2 illustrates the cable systems for moving two trolleys on the crane of FIG. 1 and associated elements in a perspective view.

The drive mechanism is better seen in FIG. 2 from which most elements of the afore-described crane structure have been omitted for the sake of clarity. The drum 30 is coaxilly mounted on the output shaft 31 of a reversible gear motor, not otherwise shown. The two terminal portions 32*a*, 32*b* of a cable 32 are wound on the drum 30 and tangentially extend away from the drum in a clockwise direction, as viewed in FIG. 2, toward guide pulleys 36, 48 high on the central portion of the beam 14 and guide pulleys 38, 46 on the free end portion of the beam. The terminal cable portion 32*a* then is trained in a loop over a first pulley 44 on the trolley 15. The two, almost parallel strands of the loop extend from the pulley 44 toward the free end portion of the beam. The terminal cable portion 32b is trained in a corresponding loop over a first pulley 40 on the trolley 13. Respective strands of the two loops are integrally connected by a portion of the cable 32 trained over a reversing pulley 42 coaxial with the guide pulleys 38, 46.

The two terminal portions 34*a*, 34*b* of another cable 34 are wound on the drum 30 in such a manner that they tangentially extend away from the drum in a counterclockwise direction, as viewed in FIG. 2, toward guide pulleys 50, 58 on the pivotally fastened end portion of the beam 14, and are then trained in loops over respective second pulleys 52, 56 on the trolleys 13, 15 in the manner described above with reference to the cable 32. The two terminal cable portions 34*a*, 34*b* are connected integrally by a portion of the cable 34 trained over a reversing pulley 54 which is secured to the beam 14 by a slide 60 that may be adjusted longitudinally of the pivoted end portion of the beam in a known manner, as is indicated by a double arrow, for adjusting the tensions in the two tension systems constituted essentially by the cables 32, 34 in the illustrated embodiment of the invention. A brake 59, conventional in itself, may prevent movement of the trolley 15 along the beam 14.

The afore-described drive mechanism operates as follows:

When the two trolleys 13, 15 are coupled to each other by the load carrier 19, and the brake 59 is released, the trolleys 13, 15 move jointly toward the free end portion of the beam 14 when the cable drum 30 is turned counterclockwise by the drive shaft 31, and toward the pivotally fastened end portion of the beam when the drum is turned clockwise. When the load carrier 19 is removed from the hooks 18, 20, and the brake 59 is applied, the trolley 15 stands still during rotation of the drum 30, but the trolley 13 is moved along the beam 14 at twice the speed prevailing during joint trolley movement. When coupled, the two trolleys thus can handle loads to the full capacity of the crane, while the trolley 13 alone can handle lighter loads at higher horizontal travel speeds, the trolley 15 normally being positioned at the pivotally fastened end of the beam 14 when idle so as to apply only minimal torque to the beam. The crane of the invention thus provides the desirable features of a dualtrolley crane outlined above without the need for two separate drive systems or a gear transmission linking both trolleys to a single prime mover.

It is normally preferred to employ separate respective cables 32, 34 for the two tension systems of the trolley driving mechanism illustrated in FIG. 2, but it is obvious from inspection of the drawing and the above description of FIG. 2 that the cables 32, 34 may be lengths of the same continuous cable wound on the drum 30 in two groups of turns sufficient in number to prevent slipping of the single cable when the drum 30 turns or otherwise secured on the drum.

Figure 3:
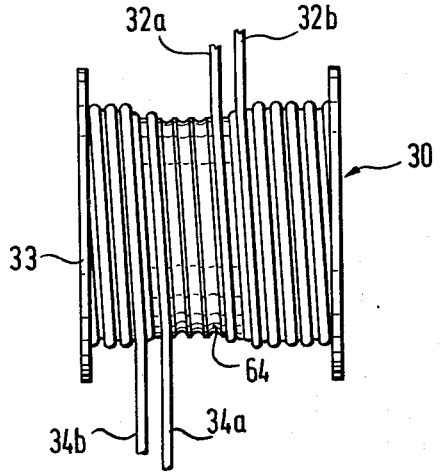
FIG. 3 is an enlarged plan view of a cable drum on the crane of FIG. 1.
Figure 4:
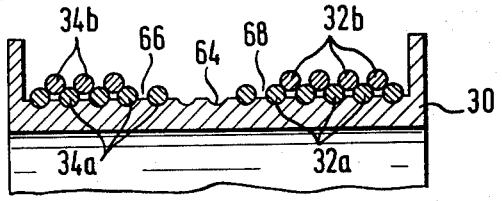
FIG. 4 shows the drum of FIG. 3 in further enlarged fragmentary section through its axis.
Figure 5:
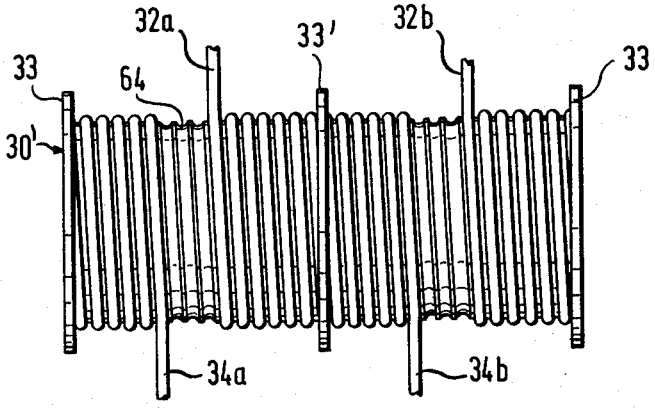
FIG. 5 illustrates a modified cable drum in a view corresponding to that of FIG. 3.

Preferred arrangements of the cable ends wound on the driven cable drum in the crane of the invention are shown in more detail in FIGS. 3 to 5.

As is shown in FIGS. 3 and 4, the drum 30 is provided with axially terminal, radial flanges 33 to which the terminal cable portions 32*a*, 32*b*, 34*a*, 34*b* are fixedly fastened in a conventional manner, not shown. The axial face of the drum is formed with a single helical groove 64 extending at uniform pitch from one flange 33 to the other. Respective groups of turns of the terminal cable portions 32*a*, 34*a* are received in the groove 64, one last turn of each group being fastened to a respective flange 33, and the other last turn being superposed on an axially central portion of the drum 30 adjacent the corresponding last turn of the other group and merging into a tangentially extending part of the same terminal cable portion.

The faces of the several turns of the cable portions 32*a*, 34*a* which are directed outward of the groove 64 define two further helical grooves 66, 68 in which groups of turns of the terminal cable portions 32*b*, 34*b* are received, one last turn of each of the latter groups being fastened to an associated flange 33, and the other turn being axially adjacent the corresponding turn of the other group. Each of the four groups of turns is wound on the drum 30 in a single layer, the turns of the terminal cable portions 32*a*, 34*a* being more numerous than those of the cable portions 32*b*, 34*b* so that the several tangential parts of the terminal cable portions do not tangle during rotation of the drum 30 although they are closely juxtaposed. The axial spacing of the several tangential cable parts remains constant during rotation of the drum 30.

The arrangement illustrated in FIGS. 3 and 4 is generally preferred because it permits the use of a single, axially short cable drum, but other arrangements are possible and may be resorted to under suitable conditions. One such alternative arrangement is shown in FIG. 5.

The drum 30' is of sufficient axial length to accomodate all turns of the terminal cable portions 32*a*, 32*b*, 34*a*, 34*b* in a single layer, a helical groove 64 extending between the axially terminal flanges 33 of the drum. The axial face of the drum 30' is divided into two portions by a central flange 33'. The four terminal portions of the cables 32, 34 are fixedly fastened to the central flange 33' or to a respective axially terminal flange 33 in a non-illustrated manner, and terminal portions of the two tension systems alternate axially on the cable drum circumference. The last turn of each group of turns adjacent the tangentially extending part is axially adjacent the corresponding last turn of the other group of turns on the same axial drum portion. The arrangement differs from that illustrated in FIGS. 3 and 4 by substituting greater axial drum length for two superimposed layers of cable turns. Still, the uniform spacing of the tangential cable parts during rotation of the drum 30' is maintained.

It is preferred to use a single, integral length of cable 32, 34 for each of the two tension systems which pull one trolley 13 or both trolleys 13, 15 in respective directions along the beam 14. However, the reversing pulleys 42, 54 and the cable portions trained over them may be replaced without change in function by two-armed levers respectively fulcrumed on the end portions of the beam 14, whose arms are attached to two terminal cable portions, or by drums analogous to the drum 30 from which one terminal portion is unwound while the other is being wound thereon. Other mechanisms for reversing the direction of movement and of tension in a tension system according to the invention will readily suggest themselves. The levers and drums may be shifted along the beam 14 on slides 60 as described with reference to the pulley 54 and for the same purpose.

Some of the guide pulleys shown in FIG. 2 may be mounted on the column 10 rather than on the beam 14 without significant effect on the operation of the device, and some may be omitted if the configuration of the beam permits. In the illustrated apparatus, the guide pulleys 50, 58 may be dispensed with if the cable drum 30 is shifted closer to the pivoted end of the beam 14.

As is implied in the showing of FIG. 2, the trolleys 13, 15 travel on a common track and are therefore aligned longitudinally of their direction of movement. This is not necessary, however, and the invention is equally applicable to cranes equipped with transversely offset, separate tracks for two trolleys so that one trolley may be stationed anywhere on the beam without interfering with movement of the other trolley. Such an arrangement is often more advantageous in a bridge crane having a beam supported by respective upright columns at both ends. In such a crane, one may also prefer to equip both trolleys with brakes in a manner obvious from FIG. 2 so that either trolley may be arrested.

The beam 14 need not be horizontal or almost horizontal to provide the benefits of the invention. They are available whenever the beam is elongated in a direction having a sufficient horizontal component to permit the hooks 18, 20 depending from the two trolleys to clear each other.

It should be understood, therefore, that the foregoing disclosure relates only to preferred embodiments of the invention and that it is intended to cover all changes and variations of the examples of the invention herein chosen for the purpose of the disclosure which do not constitute departures from the spirit and scope of the invention set forth in the appended claims.

What is claimed is:

1. In a crane including a beam elongated in a horizontally extending direction and having two longitudinal end portions; two trolleys mounted on said beam for longitudinal movement; a first pulley and a second pulley on each trolley; hoisting means on each trolley for raising and lowering a suspended load; and drive means for moving said trolleys on said beam, the improvement in the drive means which comprises:

a. cable drum means rotatably secured against movement longitudinally of said beam;

b. drive means for alternatively rotating said drum means in two opposite directions;

c. two elongated tension systems, each system having two flexible terminal portions secured to said drum means and a tension reversing portion movably secured to a respective one of said end portions and longitudinally connecting said terminal portions, 1. said terminal portions of one system being wound onto said drum means and the terminal portions of the other system being unwound from said drum means when said drum means is rotated in one of said two directions, 2. said terminal portions of said other system being wound onto said drum means and the terminal portions of said one system being unwound from said drum means when said drum means is rotated in the other one of said two directions;

d. first guide means guiding each of the two terminal portions of said one system from said drum means to said tension reversing portion of the one system in two strands trained in a loop over a respective one of said first pulleys, said strands extending from the associated first pulley toward the end portion of the beam secured to said tension reversing portion of the first system; and e. second guide means guiding each of the two terminal portions of said other system from said drum means to said tension reversing portion of said other system in two strands trained in a loop over a respective one of said second pulleys, said strands extending from the associated second pulley toward the end portion of the beam secured to said tension reversing portion of said other system.

2. In a crane as set forth in claim 1, each tension reversing portion including a reversing pulley mounted on the respective end portion, and an elongated, flexible tension member trained over said reversing pulley and integrally connecting said terminal portions.

3. In a crane as set forth in claim 2, means for shifting one of said reversing pulleys longitudinally of said beam and for thereby varying the tension in at least one of said systems.

4. In a crane as set forth in claim 1, one terminal portion of said one system being wound on said drum means in axially consecutive, contiguously juxtaposed, helical turns, whereby respective faces of said turns directed away from said drum means define a helical groove, the other terminal portion of said one system being wound on said drum means in helical turns received in said groove.

5. In a crane as set forth in claim 4, said drum means including a drum member having a circumferential face formed with a helical groove, said turns of said one terminal portion being received in said groove of said drum member.

6. In a crane as set forth in claim 1, said drum means include a drum member rotatable about an axis, said drum member having a first portion and a second portion axially offset from said first portion, one terminal portion of each of said systems being wound on one of said portions of said drum member, and the other terminal portion of each system being wound on the other portion of said drum member, said terminal portions constituting respective groups of helical turns axially juxtaposed on said drum member, the groups of turns of one tension system axially alternating with the groups of turns of the other tension system, an axially last turn of each group merging into a part of the respective terminal portion extending away from said drum member in a substantially tangential direction, the tangentially extending parts of the two terminal portions on each of said portions of said drum member being closely juxtaposed in an axial direction, and the groups of turns of said two portions extending axially away from the juxtaposed parts in respective opposite axial directions.

* * * * *